United States Patent [19]

Buchanan, Jr. et al.

[11] 4,183,026

[45] Jan. 8, 1980

[54] ANTENNA MOUNT FOR A VEHICLE RADIO ANTENNA

[75] Inventors: Harry C. Buchanan, Jr., Springvalley, Ohio; James L. Hussey, Centerville, Ohio

[73] Assignee: General Motors Corporation

[21] Appl. No.: 923,395

[22] Filed: Jul. 10, 1978

[51] Int. Cl.[2] ..... H01Q 1/32; H01Q 9/30; H01B 17/26

[52] U.S. Cl. ..... 343/715; 343/900; 174/153 A

[58] Field of Search ..... 174/153 A; 343/715, 343/889, 900

[56] References Cited

U.S. PATENT DOCUMENTS

| | | | |
|---|---|---|---|
| 2,496,938 | 2/1950 | Friedman | 174/84 |
| 3,444,313 | 5/1969 | Goodchild, Jr. et al. | 174/153 |
| 3,798,651 | 3/1974 | Lehman | 174/153 A |

FOREIGN PATENT DOCUMENTS

| | | | |
|---|---|---|---|
| 2041009 | 3/1972 | Fed. Rep. of Germany | 343/715 |
| 2616968 | 10/1977 | Fed. Rep. of Germany | 343/715 |

*Primary Examiner*—Alfred E. Smith
*Assistant Examiner*—Harry E. Barlow

[57] ABSTRACT

An antenna mount for a retractable antenna has a collapsible spacer to permit the antenna mount to conform to the shape of the surface to which the antenna is mounted. The collapsible spacer has a plurality of cantilever springs formed thereon which permit one end of the spacer to angulate relative to the centerline of the spacer while the spacer collapses in a direction generally parallel to the centerline thereof without significant change in the diameter of the spacer.

2 Claims, 3 Drawing Figures

ANTENNA MOUNT FOR A VEHICLE RADIO ANTENNA

This invention relates to antenna mounts and more particularly to antenna mounts which conform to a mounting surface.

It is an object of this invention to provide an improved antenna mount structure for a vehicle radio antenna.

Another object of this invention is to provide an improved antenna mount structure with a collapsible spacer having a plurality of cantilever springs formed thereon to permit substantially linear collapsing and conformity to the mounting surface.

A further object of this invention is to provide an improved antenna mount for a vehicle radio antenna having a collapsible portion which does not significantly increase in diameter while permitting conformance with the mounting surface and which collapsible portion maintains a high contact force with the mounting surface.

These and other objects and advantages of the present invention will be more apparent from the following description and drawings in which.

Figure 1:
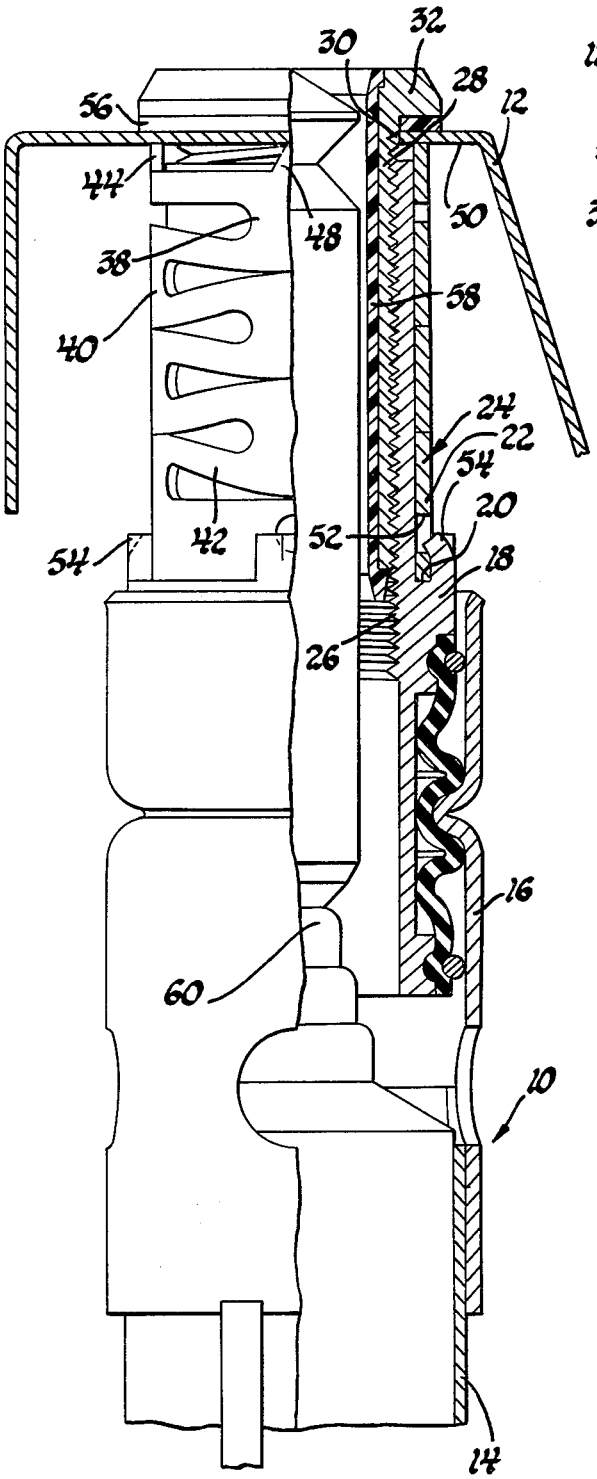
FIG. 1 is an elevational view, partly in section, of the antenna mount.

Referring to the drawings, wherein like characters represent the same or corresponding parts throughout the several views, there is seen in FIG. 1 a portion of an antenna structure generally designated 10, which is secured to a vehicle body portion, such as a fender 12. The antenna structure 10 has a mast jacket 14 to which is secured a shield 16 which in turn is fixed to a mounting housing 18. The mounting housing 18 has an annular support surface 20 on which is supported a base portion 22 of a collapsible spacer 24. The housing 18 also has an interior threaded portion 26 into which is threaded a fastener 28 extending through an opening 30 in the body member 12 and terminating in a head portion 32 of larger diameter than the opening 30.

Figure 2:
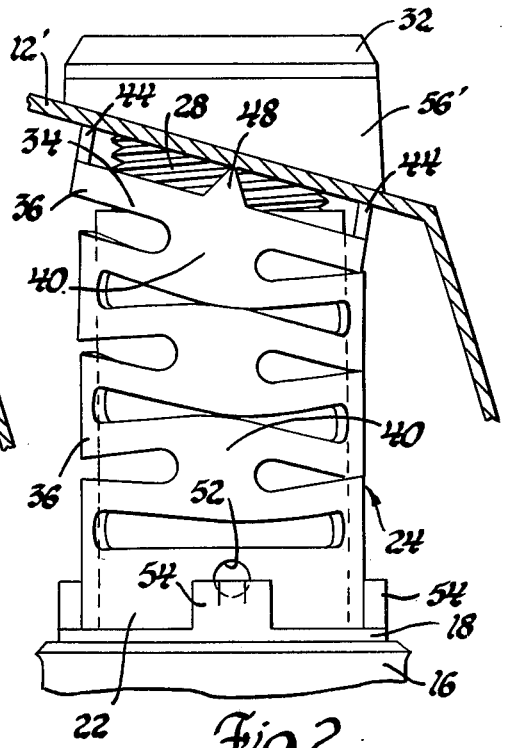
FIG. 2 shows the antenna mount secured to a sloping surface.
Figure 3:
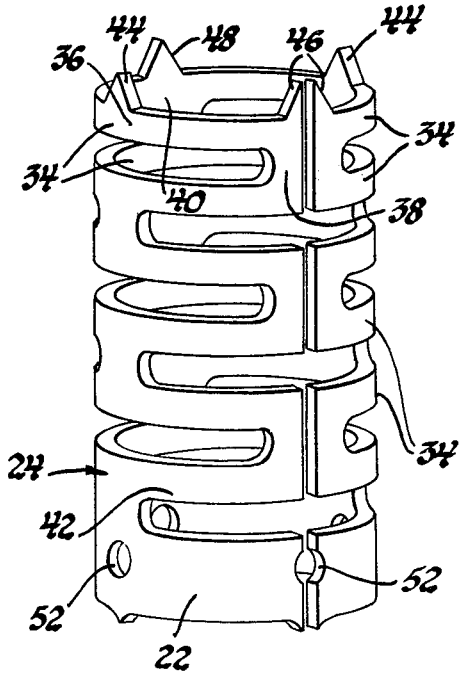
FIG. 3 is a perspective view of the collapsible portion of the antenna mount.

As best seen in FIG. 3, the spacer 24 is comprised of a plurality of cantilever springs 34, each of which has a free end 36 and base ends 38 and 40. The base ends 38 and 40 are secured to the free end of the next succeeding cantilever spring and the base ends of the bottom springs 42 are secured to the base 22 of spacer 24. The free ends 36 and base ends 38 and 40 of the uppermost springs 34 have formed thereon upstanding triangular portions 44, 46 and 48, respectively, which are adapted to engage the inner surface 50 of the body member 12, as seen in FIGS. 2 and 3.

In the base 22 of spacer 24 is formed a plurality of apertures 52 which, when the base 22 is supported on annular support surface 20, are aligned with retaining lugs 54 formed on the housing 18. The retaining lugs 54 have a portion thereof deformed radially inwardly to engage the apertures 52 thereby preventing relative movement between the base 22 of spacer 24 and the housing 18.

When the antenna is first mounted in a vehicle, the spacer 24 is in its uncollapsed state, as shown in FIG. 3. As fastener 28 is threaded into housing 18, the base 22 of spacer 24 is moved along with housing 18 toward the body member 12 while the triangular portions 44, 46 and 48 are engaged with the body 12 such that the cantilever springs 34 will be forced to deflect, as shown in FIG. 1. During the collapsing of spacer 24, the cantilever springs 34 will undergo some plastic deformation, however, the springs 34 do maintain sufficient spring force such that a high contact force with surface 50 is present. An insulating washer 56 is disposed between the head 32 of fastener 28 and the body member 12 which permits the fastener 28 to be rotated relative to the body member 12 without generating high frictional force during assembly. An insulating sleeve 58 is secured to the inner surface of fastener 28 such that the extensible portion 60 of antenna 10 will not electrically contact the mounting structure during extension and retraction of the antenna.

As seen in FIG. 2, the body portion 12' may be sloped relative to the longitudinal axis of the spacer 24 and the cantilever springs 34 will deform accordingly, to permit conformance with the sloping surface. When the vehicle body surface is sloping, as shown in FIG. 2, a complementary shaped washer 56' must be utilized between the head end 32 of fastener 28 and the vehicle body 12'.

The lattice work of cantilever springs minimizes the weight of the collapsible member and allows control of the bearing load over a wide range of deflections which may be encountered on various surface shapes. This permits one collapsible member to be utilized in antenna mounts for a number of vehicle body designs. The spring force stored in the collapsible member resists the forces tending to loosen the unit after assembly by compensating for the creep factor of the materials used in the fastener and gaskets.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An antenna mount for a vehicle radio antenna having a mast slidably disposed in a mast jacket and being extensible and retractable through an opening in the vehicle body, said antenna mount comprising; a housing connected to said mast jacket and having a cylindrical body portion with an internally threaded surface, an annular support surface extending radially outward from said cylindrical body portion and a plurality of retaining members extending axially from said annular support surface and being spaced radially from said cylindrical body portion; a collapsible spacer having a generally cylindrical shape and having formed thereon a support portion, a plurality of serially arranged pairs of cantilever springs with each spring having a free end and a base end, a first pair of said springs having surface engaging means for engaging the inner surface of said vehicle body adjacent the opening therein and the base ends integral with the free ends of a second pair of said springs in the series, each of the pairs of springs intermediate the first and last pairs of springs having the free ends thereof integral with the base ends of the prior pair of springs and the base ends thereof integral with the free ends of the next following pair of springs, and said last pair of springs having the base ends thereof integral with said support portion of said collapsible spacer and a plurality of retaining means formed on said support portion for cooperating with said retaining members on said housing to prevent relative movement between said housing and said support portion of said collapsible spacer; and fastening means having an externally threaded portion engaged in the internally threaded surface and a head portion abutting the outer surface of said vehicle body circumjacent the opening therein, said fastening means being rotatable to cause said housing and said collapsible spacer to move longitudinally toward said vehicle body and said collapsible spacer being deformed at said cantilever springs to conform to the inner surface of said vehicle body and to maintain a retaining force against said vehicle body.

2. An antenna mount for a vehicle radio antenna having a mast slidably disposed in a mast jacket and being extensible and retractable through an opening in the vehicle body, said antenna mount comprising; a housing connected to said mast jacket and having a cylindrical body portion with an internally threaded surface, a collapsible spacer having a generally cylindrical shape and having formed thereon a support portion, a lattice work of pairs of cantilever springs, the springs at one end of the lattice work having surface engaging means for engaging the inner surface of said vehicle body adjacent the opening therein, the springs at the other end of said lattice work being integral with said support portion of said collapsible spacer, and retaining means for connecting said support portion to said housing to prevent relative movement between said housing and said support portion of said collapsible spacer; and fastening means having an externally threaded portion engaged in the internally threaded surface and a head portion abutting the outer surface of said vehicle body circumjacent the opening therein, said fastening means being rotatable to cause said housing and said collapsible spacer to move longitudinally toward said vehicle body and said collapsible spacer being deformed at said cantilever springs to conform to the inner surface of said vehicle body and to maintain force against said vehicle body.

* * * * *

UNITED STATES PATENT AND TRADEMARK OFFICE

CERTIFICATE OF CORRECTION

PATENT NO. : 4,183,026

DATED : January 8, 1980

INVENTOR(S) : Harry C. Buchanan, James L. Hussey

It is certified that error appears in the above-identified patent and that said Letters Patent are hereby corrected as shown below:

Column 4, line 18, after "maintain", insert -- a retaining --.

Signed and Sealed this

*Eighth* Day of *July 1980*

[SEAL]

*Attest:*

SIDNEY A. DIAMOND

*Attesting Officer*

*Commissioner of Patents and Trademarks*